US010274257B2

(12) United States Patent
Wu et al.

(10) Patent No.: US 10,274,257 B2
(45) Date of Patent: Apr. 30, 2019

(54) METHOD AND DEVICE FOR PREPARING A SINTERED ND—FE—B PERMANENT MAGNET

(71) Applicants: Jingfeng Wu, Taiyuan (CN); Jingshan Wu, Taiyuan (CN)

(72) Inventors: Jingfeng Wu, Taiyuan (CN); Jingshan Wu, Taiyuan (CN)

(73) Assignee: HANXI HENGLICHENG MAGNETIC INDUSTRY CO., LTD., Taiyuan, Shanxi Province (CN)

( * ) Notice: Subject to any disclaimer, the term of this patent is extended or adjusted under 35 U.S.C. 154(b) by 983 days.

(21) Appl. No.: 14/180,827

(22) Filed: Feb. 14, 2014

(65) Prior Publication Data

US 2014/0294655 A1 Oct. 2, 2014

(30) Foreign Application Priority Data

Mar. 27, 2013 (CN) ..... 2013 1 0099659

(51) Int. Cl.

| | |
|---|---|
| ***C22C 33/02*** | (2006.01) |
| ***H01F 1/057*** | (2006.01) |
| ***H01F 41/02*** | (2006.01) |
| ***F27D 7/06*** | (2006.01) |

(52) U.S. Cl.

CPC ..... *F27D 7/06* (2013.01); *C22C 33/0207* (2013.01); *H01F 1/0573* (2013.01); *H01F 1/0577* (2013.01)

(58) Field of Classification Search

None

See application file for complete search history.

(56) References Cited

U.S. PATENT DOCUMENTS 3,254,401 A * 6/1966 Grego ..... B21C 23/32 29/423
4,793,874 A * 12/1988 Mizoguchi ..... H01F 1/0577 148/103

(Continued)

FOREIGN PATENT DOCUMENTS

JP H07054003 A * 2/1995 ..... B22F 1/00
WO WO-2012105399 A1 * 8/2012 ..... C22C 38/002

OTHER PUBLICATIONS

JP H07-054003 machine translation (Year: 1995).*

*Primary Examiner* — Paul A Wartalowicz
*Assistant Examiner* — Stephani Hill
(74) *Attorney, Agent, or Firm* — Morgan, Lewis & Bockius LLP

(57) ABSTRACT

The present invention is directed to a method for preparing a permanent magnet, and more specifically, to a method for preparing a high-performance sintered Nd—Fe—B permanent magnet, in order to solve the problems of increased brittleness or high cost present in the permanent magnet prepared by the existing process. A method for preparing a sintered Nd—Fe—B permanent magnet includes the step of ingredient calculation and raw material preparation including calculating ingredients and preparing raw materials according to the ingredient formula of the resultantly sintered Nd—Fe—B permanent magnet, and dividing the raw materials into a rare earth Fe—B compound and rare earth metals.

6 Claims, 3 Drawing Sheets

(56) References Cited

U.S. PATENT DOCUMENTS

| | | | | |
|---|---|---|---|---|
| 5,580,396 | A * | 12/1996 | Fruchart | B22F 9/023 148/101 |
| 6,444,048 | B1 * | 9/2002 | Hasegawa | C22C 1/0441 148/101 |
| 2010/0034688 | A1 * | 2/2010 | Nagata | B22F 3/02 419/32 |
| 2012/0299675 | A1 * | 11/2012 | Honkura | C22C 1/0441 335/302 |
| 2013/0309122 | A1 * | 11/2013 | Mochizuki | C22C 38/002 419/33 |

* cited by examiner

METHOD AND DEVICE FOR PREPARING A SINTERED ND—FE—B PERMANENT MAGNET

RELATED APPLICATION

This application claims the benefit of and priority to Chinese Patent Application No. 201310099659.2, filed Mar. 27, 2013, the entire disclosure of which is hereby incorporated by reference.

FIELD OF THE INVENTION

The present invention relates to a method for preparing a permanent magnet material, and more specifically, to a method for preparing a high-performance sintered Nd—Fe—B permanent magnet.

BACKGROUND OF THE INVENTION

Permanent magnet material is a very important basic material for the currently hi-tech industry. Due to its high magnetic energy product and coercivity, the third generation of rare earth permanent magnet, known as "the king of magnets", which is neodymium iron boron (Nd—Fe—B), is widely applied to various fields like computers, automobiles, wind turbines, MRI machines, mobile phones, frequency-converted appliances, audio equipments, etc.

Rare earth refers to the lanthanides in the Periodic Table of Chemical Elements, that is, La, Ce, Pr, Nd, Pm, Sm, Eu, Gd, Tb, Dy, Ho, Er, Tm, Yb, Lu, and two elements closely related to the 15 lanthanides, that is, Sc, and Y. These 17 elements are collectively named as Rare Earth, or simply, RE or R.

Nd—Fe—B permanent magnet materials consist of sintering and adhering families. The process below is usually adopted when producing a high-performance sintered Nd—Fe—B magnet material:

calculating of ingredient→weighing and preparing of raw materials→vacuum fusing→quick condensing and casting→hydrogen decrepitating and dehydrogenating→airflow pulverizing→mixing→magnetic field orienting and shaping→vacuum sintering and tempering.

Specifically, the ingredient formula of the sintered Nd—Fe—B permanent magnet material in mass fraction is $(Nd_{A-X}RE_X)_A(Fe_{bal-y}M_y)_{bal}B_C$, in which RE represents one or several of the rare earth elements except Nd, M represents one or several among the metal elements Al, Ga, Cu, Nb, Mo, W, V, Ta, Cr, Ti, Zr, Hf, Si, Ni, Sn, Mn, x stands for the mass fraction of RE in the whole permanent magnet material, i.e., the mass fraction of Nd replaced by RE, y stands for the mass fraction of other metals M in the whole permanent magnet material, i.e., the mass fraction of Fe replaced by other metals M, bal refers to the balance, and A %+C %+bal %=100%. The theoretical value range of A in the well-known high-performance sintered Nd—Fe—B permanent magnet material of this field varies from 26.7 to 33; however, given the loss of the RE elements in industrialized production, the value of A in practical production usually exceeds 28, and the value ranges of C, y and x are 0.5~2, 0~40 and 0~10, respectively. Based on the different magnetic properties of permanent magnet to be desired, technicians of this field calculate the weight of each element actually needed according to the above formula and then gather the weighed and prepared raw materials into a group, and quickly condense them into a casting alloy through vacuum fusion. Due to the property of the rare earth metal which becomes intumescent in volume after hydrogen absorption, coarse powders may be obtained by placing the casting alloy containing rare earth metals into a hydrogen decrepitation furnace to perform the hydrogen absorption and dehydrogenation when producing the high-performance sintered Nd—Fe—B permanent magnet material.

A lot of researches and production practices have proved that, compared with other methods of hydrogen decrepitation, the performance of the magnet can be improved by dehydrogenizing the hydrogen-decrepitated coarse powders through heating. And, only when the remaining hydrogen content is below 50 ppm, it can be guaranteed that there exists no fine crack in the resultantly permanent magnet, which has even bending strength and excellent mechanical properties, from which the subsequent machining is facilitated.

Casting alloy substantially contains two compounds: main phase ($RE_2Fe_{14}B$) and rare earth-rich phase (Nd—Fe alloy mainly composed of Nd and other rare earth elements). Since the dehydrogenation temperature of the main phase and that of the rare earth-rich phase differs, dehydrogenation of main phase hydrides occurs at a temperature of 100° C. to 300° C., while partial dehydrogenation of rare earth-rich phase hydrides starts to occur when heated to a temperature of 350° C. to 600° C. and complete dehydrogenation occurs as the temperature is above 600° C. However, when heated to the temperature of above 600° C., a part of the main phase $RE_2Fe_{14}B$ would generate a disproportionated reaction to produce non-magnetic or soft magnetic phases, leading to severe deteriorating in magnetic performance of the permanent magnet. Therefore, it is impossible to dehydrogenize the two phases of such two phase-integrated casting alloy separately, in order to compromise for both phases, at present, it is common to dehydrogenize at a temperature of 550° C. to 590° C. Remaining hydrogen content in the magnetic powders is approximately between 500 and 3500 ppm, after thermal insulation for 4-15 hours, and most of the rest hydrogen would be dehydrogenized in the subsequent vacuum sintering. The hydrogen content of the sintered magnet could be below 10 ppm, but due to the diffusion of hydrogen towards the outside in the process of sintering, a portion of the outside of the magnet may be hydrogenated again, or hydrogen may exist in a free form in the cracks of magnet, leading to the generation of fine cracks, which results in increased brittleness and decreased bending strength of the magnet, as well as the severely deteriorated machineable property. For the high-performance Nd—Fe—B permanent magnet material, a bulk magnet is usually cut into small pieces for use through machining, even though it is used as a whole, potential quality risk exists because of the fine cracks in the magnet. Currently, in order to prevent the defects of the magnet in mechanical properties caused by great loss of hydrogen during sintering, the hydrogen content is required to be below 50 ppm as possible at the stage of dehydrogenation of the magnetic powders, which generally can only be realized by thermal insulation for about 40 hours at a temperature between 550° C. and 590° C., leading to sufficient increase in production cost and severe decrease in production efficiency.

Therefore, the drawbacks of the existing process are as follows: when performing dehydrogenation with the existing process, there would be either incomplete dehydrogenation (i.e., hydrogen content above 50 ppm) and fine cracks in the magnet caused by the subsequent sintering, leading to increase in brittleness of the magnet, or too much time for thermal insulation may result in low efficiency and increased cost.

SUMMARY OF THE INVENTION

The present invention provides a method for preparing a sintered Nd—Fe—B permanent magnet, aiming at solving the above problems existing in the current process.

The present invention is carried out by adopting the technical solution as follows.

A method for preparing a sintered Nd—Fe—B permanent magnet includes the following steps: (1) ingredients calculation and raw materials preparation in which calculating ingredients and preparing raw materials according to the ingredient formula of the resultantly sintered Nd—Fe—B permanent magnet in mass fraction, i.e., $(Nd_{A-X}REx)_A(Fe_{bal-y}M_y)_{bal}B_{0.95\sim1.03}$, in which A %+(0.95~1.03)%+bal %=100%; then dividing the raw materials into a rare earth Fe—B compound and rare earth metals, the formula of the rare earth Fe—B compound in mass fraction being $(Nd_{28-a}RE_a)_{28}(Fe_{bal-y}M_y)_{bal}B_{0.95\sim1.03}$ and that of the rare earth metals being $(Nd_{A-28-b}RE_b)_{A-28}$, wherein RE represents one or several of rare earth elements except Nd, M represents one or several among the metal elements Al, Ga, Cu, Nb, Mo, W, V, Ta, Cr, Ti, Zr, Hf, Si, Ni, Sn, Mn, $28<A\leq33$, and a+b=x;

(2) according to the formula of the rare earth Fe—B compound in mass fraction which is $(Nd_{28-a}RE_a)_{28}(Fe_{bal-y}M_y)_{bal}B_{0.95\sim1.03}$, vacuum fusing the weighed and prepared raw materials and quickly condensing them into a casting alloy of the rare earth Fe—B compound, followed by hydrogen absorption to decrepitate the casting alloy into hydride powders, then heating them to a temperature between 400° C. and 420° C. for thermal insulation to perform dehydrogenation until the hydrogen content of the hydride powders being below 50 ppm;

(3) according to the formula of the rare earth metals in mass fraction which is $(Nd_{A-28-b}RE_b)_{A-28}$, performing hydrogen absorption on the weighed and prepared rare earth metals to decrepitate into hydride powders, then heating them to a temperature between 830° C. and 860° C. for thermal insulation to perform dehydrogenation until the hydrogen content of the hydride powders being below 50 ppm; and (4) mixing the hydride powders of both the rare earth Fe—B compound and the rare earth metals prepared respectively in steps (2) and (3), then airflow pulverizing them into fine powders, after the mixture of the powders, through magnetic field orienting and shaping, sintering and tempering, the sintered Nd—Fe—B permanent magnet is obtained.

Note that "-" in "A-x", "bal-y", "28-a", "A-28" and "A-28-b" means minus.

Technicians of this field should understand that the preparation proportion of the mass fraction of individual ingredients of the Nd—Fe—B permanent magnet is closely related to the properties of the final magnet. Based on the present invention, the hydrogen absorption, decrepitation and dehydrogenation of the rare earth Fe—B compound and the rare earth metals are carried out, respectively. In step (1), the rare earth Fe—B compound ($(Nd_{28-a}RE_a)_{28}(Fe_{bal-y}M_y)_{bal}B_{0.95-1.03}$) is closer to the main phase $RE_2Fe_{14}B$ (automatic ratio) in component design to guarantee the high performance of the final magnet. Through separate hydrogen absorption and dehydrogenation of the rare earth Fe—B compound after being quickly condensed into the casting alloy and separate hydrogen absorption and dehydrogenation of the rare earth metals, it is possible to make the rare earth Fe—B compound quickly dehydrogenized to the hydrogen content below 50 ppm at the temperature between 400° C.~420° C.; and since the rare earth metals do not have main phase, there is no need to consider the disproportionated reaction occurred in dehydrogenation of the main phase as the temperature exceeds 600° C., and thus, at the temperature between 830° C. and 860° C., the rare earth metals can be quickly dehydrogenized to the hydrogen content below 50 ppm. In this way, the traditional method in which the main phase and the rare earth-rich phase is combined with each other as an integrated alloy during the processes of component design and condensing into the casting to perform hydrogen absorption and dehydrogenation is improved, and the hydrogen content of the magnetic powders is reduced to below 50 ppm after dehydrogenation in a very short production cycle, and finally, the high-performance Nd—Fe—B permanent magnet with excellent machineability is obtained. This solves the difficulties of the traditional method in meeting the conditions of dehydrogenation for both the main phase and the rare earth-rich phase, or quickly performing dehydrogenation to reduce the hydrogen content to below 50 ppm. Besides, in the processing of dehydrogenation, most of the hydrogen has been removed, so that further dehydrogenation in the subsequent sintering process is unnecessary, which avoids a second hydrogenation of a portion of the outside of the magnet because of the diffusion of hydrogen towards the outside in the process of the subsequent sintering or the fine cracks generated caused by existing of the hydrogen in the free form in the cracks of the magnet. Also, the bending strength of the permanent magnet, as well as the machineability are improved, at the same time, the brittleness of the permanent magnet is effectively decreased, which greatly improves the machineability of the permanent magnet.

In addition, while charging the airflow mill, because the ratio of the hydride powders of both the rare earth Fe—B compound and the rare earth metal adopted in the present invention is accurately calculated according to the magnetic properties to be desired and based on the ingredient formula of the high-performance sintered Nd—Fe—B permanent magnet material in mass fraction, the magnetic properties of the magnet produced by mixing the above hydride powders to make fine powders followed by the magnet field orienting and shaping, sintering and tempering are comparable to those produced by the traditional method. As for the specific data, please refer to the comparison results of Examples 1-3.

Preferably, in steps (2) and (3), hydrogen absorption and decrepitation of the rare earth Fe—B compound and the rare earth metal are separately performed in a vacuum sintering furnace, and they are both wrapped loosely with a 1 mm-thick high silica fire retardant cloth to be put into an iron container, whose charging amount can not exceed one seventh of its volume. When hydrogen absorption and decrepitation are performed at a high temperature, both the casting alloy of the rare earth Fe—B compound and the rare earth metals may make chemical combination with the container, leading to composition segregation which can be avoided through insulation by wrapping with the fire retardant cloth. The fire retardant cloth should be wrapped loosely to prevent from bursting, since it may be intumescent in volume after the hydrogen absorption, and if not wrapped with the fire retardant cloth, the fine powders of the hydride powders of both the rare earth Fe—B compound and the rare earth metals may be pumped from the vacuum furnace by the pumping force of the vacuum unit in the process of dehydrogenation, causing material shortage and the safe problem in oxidation combustion of the magnetic powders. Additionally, cooling of the hydride powders of both the rare earth Fe—B compound and the rare earth metals may be performed after dehydrogenation and the usage of the fire retardant cloth for wrapping and insulation can prevent the hydride powders from being blown away by strong wind.

Preferably, in steps (2) and (3), after the dehydrogenation of the hydride powders of both the rare earth Fe—B compound and the rare earth metals, the following steps are performed: initially cooling the powders to a temperature below 80° C. under the protection of argon in the vacuum sintering furnace; next, sealingly jointing the vacuum sintering furnace with an anti-oxidation device and inflating the anti-oxidation device with argon until the oxygen content being below 0.1; transferring the container with the hydride powders from the vacuum sintering furnace into the anti-oxidation device by using a discharging mechanism of the anti-oxidation device, cooling the powders to a temperature below 20° C. through a cooling means of the anti-oxidation device; and unwrapping the fire retardant cloth having the powders to collect the hydride powders into a storage tank connected with the anti-oxidation device, with an antioxidant accounting for 0.15% of the total weight added therein to be prepared for use in step (4).

As shown in FIGS. 1 and 2, the anti-oxidation device includes a housing 1, with one end sealed and the other end opened, installed with a flange 100. There are inflating port 2 and exhausting port 3 provided with valves in the housing 1. At the bottom of the housing 1, a discharging port 5 connected with a storage tank 4 through a valve is provided. On the sidewalls of the housing 1, there are provided several operating ports 6, each of which is sealingly attached to a rubber sleeve. Inside the housing 1, a cooling means 7 and a discharging mechanism are installed, wherein the discharging mechanism includes a lifting device 10 installed therein, at the bottom of the housing 1, above which a base body 8 is installed. A telescope boom 9 capable of stretching out from the opening end of the housing 1 is slidingly connected with the base body 8 through a track.

In FIG. 3, the vacuum sintering furnace includes a furnace body 101 installed with a furnace door 103 and inside the furnace body 101, a scaffold 102 for supporting the iron container is provided. At the end of furnace body 101 installed with furnace door 103, a flange is welded. The rest components are not drawn in the figures.

In operation, initially, the hydride powders of both the rare earth Fe—B compound and the rare earth metals are respectively cooled to the temperature below 80° C. under the protection of argon in the vacuum sintering furnace. Next, the anti-oxidation device is sealingly jointed with the vacuum sintering furnace through the flange structure; the exhausting port of the anti-oxidation device is then opened, and through which the anti-oxidation device is inflated with argon until the oxygen content is below 0.1%. After that, the sintering furnace is supplemented with argon to make the inside pressure back to the normal level. Then, the operators' hand with the rubber sleeve can stretch into the anti-oxidation device through several operating ports (the end of the rubber sleeve can be tied up to keep the sealed condition of the anti-oxidation device, and the rubber sleeve can be tightly fastened on the arm when the operator stretches his hand into the device, from which the above sealed effect can be achieved). The furnace door of the vacuum sintering furnace is opened, and the container with the hydride powders is transferred from the vacuum sintering furnace into the anti-oxidation device by the discharging mechanism of the anti-oxidation device. The specific operating steps are as follows: firstly, the base body is lowered through the lifting mechanism and the telescope boom is stretched to the bottom of the container placed on the scaffold in the vacuum sintering furnace; next, the lifting mechanism is raised to make the telescope boom lift up the container and then the telescope boom is withdrawn back into the anti-oxidation device; after that, the powders are cooled to the temperature below 20° C. through the cooling means of the anti-oxidation device and the fire retardant cloth is manually unwrapped to collect the hydride powders into the storage tank connected with the anti-oxidation device, with the antioxidant accounting for 0.15% of the total weight added therein to be prepared for use.

The adoption of solutions like wrapping with the fire retardant cloth and sealingly jointing of the anti-oxidation device with the vacuum sintering furnace, etc. solves the problems in the process of preparing the permanent magnet such as composition segregation, oxidation, material shortage, safety risk and so on, so that the high-performance sintered Nd—Fe—B permanent magnet with excellent machineability can be finally obtained.

With the Nd—Fe—B permanent magnet prepared in the present invention, the fine cracks in the resultantly prepared permanent magnet can be greatly reduced and thus the brittleness of the Nd—Fe—B permanent magnet is decreased under the condition of maintaining the magnetic energy product and coercivity, so that the permanent magnet possesses excellent machineability and as for the specific data, please refer to the comparison results of Examples 1-3. Because in the practical production, there are various ingredient preparation ratios for producing the permanent magnet due to different requirements for the properties of the permanent magnet, the comparisons on the technical effects between the existing manufacturing methods and that of the present invention are not be exhaustive herein. Therefore, the advantages of the present invention are illustrated by taking Examples 1-3 as representatives. However, on the basis of careful reading of the description, technicians of this field can predict that the permanent magnet prepared by the present invention with different raw material formulas should also possess the above advantages.

The present invention is reasonable in design and with which, the following drawbacks of the existing process can be solved, when performing dehydrogenation, there would be either incomplete dehydrogenation (i.e., hydrogen content above 50 ppm) and fine cracks in the magnet caused by the subsequent sintering, leading to increase in brittleness of the magnet, or too much time for thermal insulation resulting in low production efficiency and increased cost.

DENOTATION OF ACCOMPANYING DRAWINGS

Figure 1:
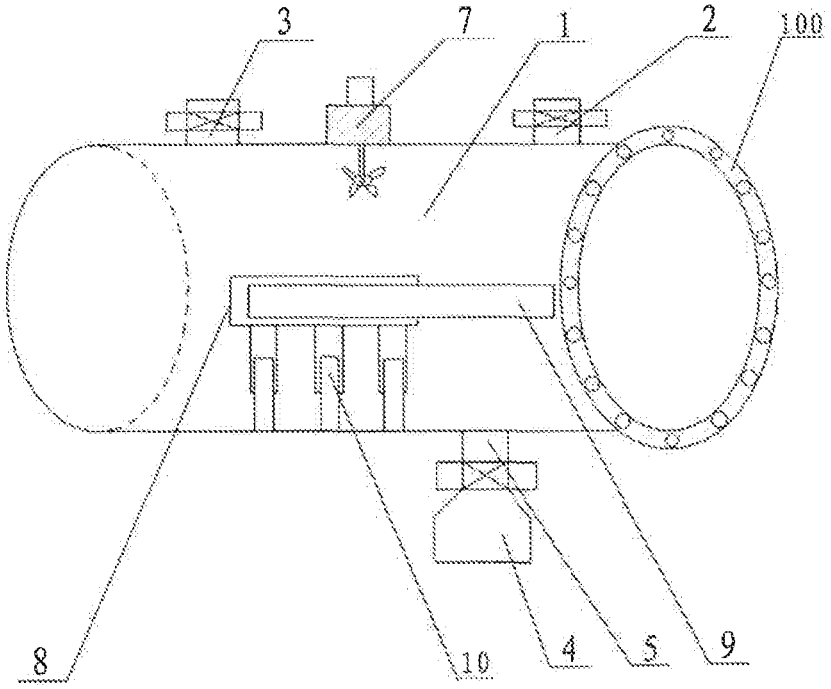
FIG. 1 is the structural schematic diagram of an anti-oxidation device.

1—housing
2—inflating port
3—exhausting port
4—storage tank
5—discharging port
6—operating port
7—cooling device
8—base body

9—telescope boom
10—lifting mechanism
100—flange
101—furnace body
102—scaffold
103—furnace door.

DETAILED DESCRIPTION OF THE PREFERRED EMBODIMENTS OF THE INVENTION

Example 1

A method for preparing a sintered Nd—Fe—B permanent magnet includes the following steps:

(1) ingredient calculation and raw material preparation in which calculating ingredients and preparing raw materials according to the ingredient formula of the resultantly sintered Nd—Fe—B permanent magnet in mass fraction, i.e., $(Nd_{24.51}Pr_{5.49})_{30}(Fe_{68.85}Ga_{0.2})_{69.05}B_{0.95}$, in which 24.51%+5.49%+68.85%+0.2%+0.95%=100%; then dividing the raw materials into a rare earth Fe—B compound and rare earth metals, the formula of the rare earth Fe—B compound in mass fraction being $(Nd_{22.876}Pr_{5.124})_{28}(Fe_{68.85}Ga_{0.2})_{69.05}B_{0.95}$ and that of the rare earth metals being $(Nd_{1.634}Pr_{0.366})_2$; based on 6 times of the calculation of the above formulas, weighing and preparing the raw materials for the rare earth Fe—B compound, that is, 168 kg of Nd—Pr alloy (in which Pr accounts for 18.3% of the total) having 137.256 kg of Nd and 30.744 kg of Pr, 27.94 kg of Fe—B alloy (in which B accounts for 20.4% of the total), 1.2 kg of metal Ga, and 390.86 kg of pure iron, which together amount to 588 kg; after that, weighing and preparing the raw materials for the rare earth metals, that is, 12 kg of Nd—Pr alloy (in which Pr accounts for 18.3% of the total); however, in practical production, in order to control the production cost and realize industrialization, 100 kg or more is usually prepared at a time;

(2) according to the formula of the rare earth Fe—B compound in mass fraction, vacuum fusing the weighed and prepared raw materials (588 kg in total) and quickly condensing them into a casting alloy of the rare earth Fe—B compound; then wrapping it loosely with a 1 mm-thick high silica fire retardant cloth (which can be used in a long term in an environment of 1000° C.) to be put into an iron container, whose charging amount can not exceed one seventh of its volume; putting the iron container into a vacuum sintering furnace which is then vacuumized to below 0.1 Pa and inflated with hydrogen to absorb hydrogen; heating it after the hydrogen absorption reaches saturation, at the same time, starting a vacuum extraction unit, performing 4-hour thermal insulation as the temperature is increased to 400° C., and then performing dehydrogenation until the hydrogen content being below 50 ppm; inflating the vacuum sintering furnace with argon after the thermal insulation and starting the cooling means (such as fan) of the vacuum sintering furnace to quickly reduce the temperature to below 80° C.; jointing the vacuum sintering furnace with an anti-oxidation device and inflating the anti-oxidation device with argon until the oxygen content being below 0.1%, then supplementing the sintering furnace with argon to make the inside pressure back to the normal level; opening the furnace door of the sintering furnace under the protection of argon in the anti-oxidation device and transferring the container with hydride powders from the vacuum sintering furnace into the anti-oxidation device by a discharging mechanism of the anti-oxidation device; cooling the powders to a temperature below 20° C. through the cooling means (such as fan) of the anti-oxidation device and unwrapping the fire retardant cloth to collect the hydride powders into a storage tank connected with the anti-oxidation device, with an antioxidant (commonly used in this field) accounting for 0.15% of the total weight added therein to be prepared for use;

(3) according to the formula of the rare earth metals in mass fraction, putting 100 kg of the weighed and prepared raw materials of Nd—Pr alloy (in which Pr accounts for 18.3% of the total), wrapped loosely with a 1 mm-thick high silica fire retardant cloth (which can be used in a long term in an environment of 1000° C.), into a containing plate to be put into the vacuum sintering furnace which is then vacuumized to below 0.1 Pa and inflated with hydrogen to absorb hydrogen; heating it after the hydrogen absorption reaches saturation, at the same time, starting the vacuum extraction unit, performing 5-hour thermal insulation as the temperature is increased to 860° C., and then performing dehydrogenation until the hydrogen content being below 50 ppm; inflating the vacuum sintering furnace with argon after the thermal insulation and starting the cooling fan of the vacuum sintering furnace to quickly reduce the temperature to below 80° C.; jointing the vacuum sintering furnace with the anti-oxidation device and inflating the anti-oxidation device with argon until the oxygen content being below 0.1%, then supplementing the sintering furnace with argon to make the inside pressure back to the normal level; opening the furnace door of the sintering furnace under the protection of argon in the anti-oxidation device and transferring the container with hydride powders from the vacuum sintering furnace into the anti-oxidation device by the discharging mechanism of the anti-oxidation device; cooling the powders to a temperature below 20° C. through the cooling means (such as fan) of the anti-oxidation device and unwrapping the fire retardant cloth to collect the hydride powders into the storage tank connected with the anti-oxidation device, with the antioxidant (commonly used in this field) accounting for 0.15% of the total weight added therein to be prepared for use;

(4) weighing and mixing 588 kg of the hydride powders of the rare earth Fe—B compound and 12 kg of the hydride powders of the rare earth metals prepared respectively in steps (2) and (3), then airflow pulverizing them into fine powders; after mixing the powders for two hours, shaping them into a compact of 56 mm×40 mm×36 mm by orienting the magnet fields; putting the compact into the vacuum sintering furnace to sinter and temper; and finally the sintered Nd—Fe—B permanent magnet with excellent machineability is obtained.

In addition, according to the frequently adopted process in the existing technologies, 6 times of the amount of the raw materials is calculated based on the proportion of the mass fraction with 24.51% of Nd, 5.49% of Pr, 0.95% of B, 0.2% of Ga, and 68.85% of Fe. The raw materials are weighed and prepared, and 180 kg of Nd—Pr alloy (in which Pr accounts for 18.3% of the total), 27.94 kg of Fe—B alloy (in which B accounts for 20.4% of the total), 1.2 kg of metal Ga, and 390.86 kg of pure iron, which together amount to 600 kg, are put into the vacuum fusion furnace to fuse and quickly condense into a casting alloy. This casting alloy is put into a hydrogen decrepitation furnace, which is then vacuumized to below 0.1 Pa and inflated with hydrogen to absorb hydrogen. It is heated after the hydrogen absorption reaches the saturation, at the same time, the vacuum extraction unit is started, and 10-hour thermal insulation is performed as the temperature is increased to 550° C. to perform dehydrogenation. The vacuum sintering furnace is inflated with argon after the thermal insulation and the cooling mechanism of the hydrogen decrepitation furnace is started to perform cooling. After being cooled, the casting alloy is airflow pulverized and the pulverized powders are mixed for two hours, with the antioxidant accounting for 0.15% of the total weight added therein before the mixture of the powders. After that, the powders are shaped into a compact of 56 mm×40 mm×36 mm by orienting the magnet fields and then put into the vacuum sintering furnace to sinter and temper.

The magnetic properties of the sintered Nd—Fe—B permanent magnets prepared respectively in Example 1 based on the existing technology and the method of the present invention are tested. The two square magnets with specifications of 56 mm×40 mm×36 mm are machined, including grinded, cut and punched, etc., to be shaped as an annulus having an outside diameter of 4.3 mm, an inner diameter of 2.2 mm and a height of 2 mm. After the annulus being chamfered, polished, plated and finished, a complete inspection on cracks is performed. The comparative data of Example 1 is listed in Table 1.

TABLE 1

| | Item | Using the method of the present invention | Using the method in the existing technology |
|---|---|---|---|
| Magnet properties | Average value of Remanence Br | 14.17 (KGs) | 14.13 (KGs) |
| | Average value of Coercivity Hci | 11.25 (KOe) | 11.26 (KOe) |
| | Average of magnetic energy product (BH) max | 47.58 (MGOe) | 47.42 (MGOe) |
| Hydrogen content after dehydrogenation | | Rare earth Fe—B compound, 36 ppm; Rare earth metals, 42 ppm | 773 ppm |
| Dehydrogenation time | | 9 hours together for the rare earth Fe—B compound and the rare earth metals | 10 hours |
| Fine crack ratio after being cut into small pieces of magnet | | 0.16% | 8.7% |

From Table 1, it can be seen that in case of the substantially same preparation proportion, with different processes of casting and dehydrogenation and same processes of airflow pulverizing, mixing, magnet field orienting and shaping, vacuum sintering and tempering, the two sintered Nd—Fe—B magnets differ little in averages of remanence, magnetic energy product and coercivity, that is, the magnetic properties are almost same. With nearly the same dehydrogenation time, few fine cracks in the sintered Nd—Fe—B permanent magnet prepared by the method of the present invention show that, with the substantially same preparation proportion, application of the method of the present invention guarantees the magnetic properties of the sintered Nd—Fe—B permanent magnet and meanwhile, machineability of product is greatly improved, so that prominent economic effects are achieved.

Example 2

A method for preparing a sintered Nd—Fe—B permanent magnet includes the following steps:

(1) ingredient calculation and raw material preparation in which calculating ingredients and preparing raw materials according to the ingredient formula of the resultantly sintered Nd—Fe—B permanent magnet in mass fraction, i.e., $(Nd_{23.718}Pr_{5.782}Dy_2)_{31.5}(Fe_{64.82}Al_{0.5}Ga_{0.3}Zr_{0.2}Co_{1.5}Cu_{0.15})_{67.47}B_{1.03}$, in which 23.718%+5.782%+2%+64.82%+0.5%+0.3%+0.2%+1.5%+0.15%+1.03% 100%; then dividing the raw materials into a rare earth Fe—B compound and rare earth metals, the formula of the rare earth Fe—B compound in mass fraction being $(Nd_{20.904}P_{5.096}Dy_2)_{28}(Fe_{64.82}Al_{0.5}Ga_{0.3}Zr_{0.2}Co_{1.5}Cu_{0.15})_{67.47}B_{1.03}$ and that of the rare earth metals being $(Nd_{2.814}Pr_{0.686})_{3.5}$; based on 6 times of the calculation of the above formulas, weighing and preparing the raw materials for the rare earth Fe—B compound, that is, 156 kg of Nd—Pr alloy (in which Pr accounts for 19.6% of the total), 12 kg of Dy, 27.225 kg of Fe—B alloy (in which B accounts for 22.7% of the total), 3 kg of metal Al, 1.8 kg of Ga, 1.2 kg of Zr, 9 kg of Co, 0.9 kg of Cu, and 367.875 kg of pure iron, which together amount to 579 kg; after that, weighing and preparing the raw materials for the rare earth metals, that is, 21 kg of Nd—Pr alloy (in which Pr accounts for 19.6% of the total); however, in practical production, in order to control the production cost and realize industrialization, 100 kg or more is usually prepared at a time;

(2) according to the formula of the rare earth Fe—B compound in mass fraction, vacuum fusing the raw materials (579 kg in total) and quickly condensing them into a casting alloy of the rare earth Fe—B compound; then wrapping it loosely with a 1 mm-thick high silica fire retardant cloth to be put into an iron container, whose charging amount can not exceed one seventh of its volume; putting the iron container into a vacuum sintering furnace which is then vacuumized to below 0.1 Pa and inflated with hydrogen to absorb hydrogen; heating it after the hydrogen absorption reaches saturation, at the same time, starting a vacuum extraction unit, performing 6-hour thermal insulation as the temperature is increased to 420° C., and then performing dehydrogenation until the hydrogen content being below 50 ppm; inflating the vacuum sintering furnace with argon after the thermal insulation and starting the cooling fan of the vacuum sintering furnace to quickly reduce the temperature to below 80° C.; jointing the vacuum sintering furnace with an anti-oxidation device and inflating the anti-oxidation device with argon until the oxygen content being below 0.1%; then supplementing the sintering furnace with argon to make the inside pressure back to the normal level; opening the furnace door of the sintering furnace under the protection of argon in the anti-oxidation device and transferring the container with hydride powders from the vacuum sintering furnace into the anti-oxidation device by a discharging mechanism of the anti-oxidation device; cooling the powders to a temperature below 20° C. through the cooling fan of the anti-oxidation device and unwrapping the fire retardant cloth to collect the hydride powders into a storage tank connected with the anti-oxidation device, with an antioxidant accounting for 0.15% of the total weight added therein to be prepared for use;

(3) according to the formula of the rare earth metals in mass fraction, putting 100 kg of the raw materials of Nd—Pr alloy (in which Pr accounts for 19.6% of the total), wrapped loosely with a 1 mm-thick high silica fire retardant cloth, into a containing plate to be put into the vacuum sintering furnace which is then vacuumized to below 0.1 Pa and inflated with hydrogen to absorb hydrogen; heating it after the hydrogen absorption reaches saturation, at the same time, starting the vacuum extraction unit, performing 7-hour thermal insulation as the temperature is increased to 830° C., and then performing dehydrogenation until the hydrogen content being below 50 ppm; inflating the vacuum sintering furnace with argon after the thermal insulation and starting the cooling fan of the vacuum sintering furnace to quickly reduce the temperature to below 80° C.; jointing the vacuum sintering furnace with the anti-oxidation device and inflating the anti-oxidation device with argon until the oxygen content being below 0.1%, then supplementing the sintering furnace with argon to make the inside pressure back to the normal level; opening the furnace door of the sintering furnace under the protection of argon in the anti-oxidation device and transferring the container with hydride powders from the vacuum sintering furnace into the anti-oxidation device by the discharging mechanism of the anti-oxidation device; cooling the powders to a temperature below 20° C. through the cooling fan of the anti-oxidation device and unwrapping the fire retardant cloth to collect the hydride powders into the storage tank connected with the anti-oxidation device, with the antioxidant accounting for 0.15% of the total weight added therein to be prepared for use;

(4) weighing and mixing 579 kg of the hydride powders of the rare earth Fe—B compound and 21 kg of the hydride powders of the rare earth metals prepared respectively in steps (2) and (3), then airflow pulverizing them into fine powders; after mixing the powders for two hours, shaping them into a compact of 56 mm×40 mm×36 mm by orienting the magnet fields; putting the compact into the vacuum sintering furnace to sinter and temper; and finally the sintered Nd—Fe—B permanent magnet with excellent machineability is obtained.

In addition, according to the frequently adopted process in the existing technologies, 6 times of the amount of the raw materials is calculated based on the proportion of the mass fraction with 23.718% of Nd, 5.782% of Pr, 2% of Dy, 1.03% of B, 0.5% of Al, 0.3% of Ga, 0.2% of Zr, 1.5% of Co, 0.15% of Cu, and 64.82% of Fe. The raw materials are weighed and prepared, and 177 kg of Nd—Pr alloy (in which Pr accounts for 19.6% of the total), 12 kg of Dy, 27.225 kg of Fe—B alloy (in which B accounts for 22.7% of the total), 3 kg of metal Al, 1.8 kg of Ga, 1.2 kg of Zr, 9 kg of Co, 0.9 kg of Cu, and 367.875 kg of pure iron, which together amount to 600 kg, are put into the vacuum fusion furnace to fuse and quickly condense into a casting alloy. This casting alloy is put into a hydrogen decrepitation furnace, which is then vacuumized to below 0.1 Pa and inflated with hydrogen to absorb hydrogen. It is heated after the hydrogen absorption reaches the saturation, at the same time, the vacuum extraction unit is started, and 12-hour thermal insulation is performed as the temperature is increased to 590° C. to perform dehydrogenation. The vacuum sintering furnace is inflated with argon after the thermal insulation and the cooling mechanism of the hydrogen decrepitation furnace is started to perform cooling. After being cooled, the casting alloy is airflow pulverized and the pulverized powders are mixed for two hours, with the antioxidant accounting for 0.15% of the total weight added therein before the mixture of the powders. After that, the powders are shaped into a compact of 56 mm×40 mm×36 mm by orienting the magnet fields and then put into the vacuum sintering furnace to sinter and temper.

The magnetic properties of the sintered Nd—Fe—B permanent magnets prepared respectively in Example 2 based on the existing technology and the method of the present invention are tested. The two square magnets with specifications of 56 mm×40 mm×36 mm are machined, including grinded, cut and punched, etc., to be shaped as an annulus having an outside diameter of 4.3 mm, an inner diameter of 2.2 mm and a height of 2 mm. After the annulus being chamfered, polished, plated and finished, a complete inspection on cracks is performed. The comparative data of Example 2 is listed in Table 2.

TABLE 2

| Item | | Using the method of the present invention | Using the method in the existing technology |
|---|---|---|---|
| Magnet Properties | Average value of remanence Br | 13.02 (KGs) | 13.16 (KGs) |
| | Average value of Coercivity Hci | 18.84 (KOe) | 18.79 (KOe) |
| | Average value of magnetic energy product (BH) max | 40.26 (MGOe) | 41.13 (MGOe) |
| Hydrogen content after dehydrogenation | | Rare earth Fe—B compound, 43 ppm; rare earth metals, 43 ppm | 1325 ppm |
| Dehydrogenation time | | 13 hours together for the rare earth Fe—B compound and the rare earth metals | 12 hours |
| Fine crack ratio after being cut into small pieces of magnet | | 0.27% | 11.14% |

From Table 2, it can be seen that in case of the substantially same preparation proportion, with different processes of casting and dehydrogenation and same processes of airflow pulverization, mixing, magnet field orienting and shaping, vacuum sintering and tempering, the two sintered Nd—Fe—B magnets differs little in remanence, magnetic energy product and coercivity, that is, the magnetic properties are almost same. With nearly the same dehydrogenation time, few fine cracks in the sintered Nd—Fe—B permanent magnet prepared by the method of the present invention show that, with the substantially same preparation proportion, application of the method of the present invention guarantees the magnetic properties of the sintered Nd—Fe—B permanent magnet and meanwhile, machineability of product is greatly improved, so that prominent economic effects are achieved.

Example 3

A method for preparing a sintered Nd—Fe—B permanent magnet includes the following steps:

(1) ingredient calculation and raw material preparation in which calculating ingredients and preparing raw materials according to the ingredient formula of the resultantly sintered Nd—Fe—B permanent magnet in mass fraction, i.e., $(Nd_{24.645}Pr_{6.355}Gd_1)_{32}(Fe_{65.9}Al_{0.8}Nb_{0.3})_{67}B_1$, in which 24.645%+6.355%+1%+65.9%+0.8%+0.3%+1%=100%; then dividing the raw materials into a rare earth Fe—B compound and rare earth metals, the formula of the rare earth Fe—B compound in mass fraction being $(Nd_{21.465}Pr_{5.535}Gd_1)_{28}(Fe_{65.9}Al_{0.8}Nb_{0.3})_{67}B_1$ and that of the rare earth metals being $(Nd_{3.18}Pr_{0.82})_4$; based on 6 times of the calculation of the above formulas, weighing and preparing the raw materials for the rare earth Fe—B compound, that is, 162 kg of Nd—Pr alloy (in which Pr accounts for 20.5% of the total), 6 kg of Gd, 29.412 kg of Fe—B alloy (in which B accounts for 20.4% of the total), 4.8 kg of metal Al, 2.77 kg of Nb—Fe alloy (in which Nb accounts for 65% of the total), and 371.018 kg of pure iron, which together amount to 576 kg; after that, weighing and preparing the raw materials for the rare earth metals, that is, 24 kg of Nd—Pr alloy (in which Pr accounts for 20.5% of the total); however, in practical production, in order to control the production cost and realize industrialization, 100 kg or more is usually prepared at a time;

(2) according to the formula of the rare earth Fe—B compound in mass fraction, vacuum fusing the raw materials (576 kg in total) and quickly condensing them into casting alloy of the rare earth Fe—B compound; then wrapping it loosely with a 1 mm-thick high silica fire retardant cloth to be put into an iron container, whose charging amount can not exceed one seventh of its volume; putting the iron container into a vacuum sintering furnace which is then vacuumized to below 0.1 Pa and inflated with hydrogen to absorb hydrogen; heating it after the hydrogen absorption reaches saturation, at the same time, starting a vacuum extraction unit, and performing 7-hour thermal insulation as the temperature is increased to 410° C., and then performing dehydrogenation until the hydrogen content being below 50 ppm; inflating the vacuum sintering furnace with argon after the thermal insulation and starting the cooling fan of the vacuum sintering furnace to quickly reduce the temperature to below 80° C.; jointing the vacuum sintering furnace with an anti-oxidation device and inflating the anti-oxidation device with argon until the oxygen content being below 0.1%; then supplementing the sintering furnace with argon to make the inside pressure back to the normal level; opening the furnace door of the sintering furnace under the protection of argon in the anti-oxidation device and transferring the container with hydride powders from the vacuum sintering furnace into the anti-oxidation device by a discharging mechanism of the anti-oxidation device; cooling the powders to a temperature below 20° C. through the cooling fan of the anti-oxidation device and unwrapping the fire retardant cloth to collect the hydride powders into a storage tank connected with the anti-oxidation device, with an antioxidant accounting for 0.15% of the total weight added therein to be prepared for use;

(3) according to the formula of the rare earth metals in mass fraction, putting raw 100 kg of the raw materials of Nd—Pr alloy (in which Pr accounts for 20.5% of the total), wrapped loosely with a 1 mm-thick high silica fire retardant cloth, into a containing plate to be put into the vacuum sintering furnace which is then vacuumized to below 0.1 Pa and inflated with hydrogen to absorb hydrogen; heating it after the hydrogen absorption reaches saturation, at the same time, starting the vacuum extraction unit, and performing 6-hour thermal insulation as the temperature is increased to 840° C., and then performing dehydrogenation until the hydrogen content being below 50 ppm; inflating the vacuum sintering furnace with argon after the thermal insulation and starting the cooling fan of the vacuum sintering furnace to quickly reduce the temperature to below 80° C.; jointing the vacuum sintering furnace with the anti-oxidation device and inflating the anti-oxidation device with argon until the oxygen content being below 0.1%, then supplementing the sintering furnace with argon to make the inside pressure back to the normal level; opening the furnace door of the sintering furnace under the protection of argon in the anti-oxidation device and transferring the container with hydride powders from the vacuum sintering furnace into the anti-oxidation device by the discharging mechanism of the anti-oxidation device; cooling the powders to a temperature below 20° C. through the cooling fan of the anti-oxidation device and unwrapping the fire retardant cloth to collect the hydride powders into the storage tank connected with the anti-oxidation device, with the antioxidant accounting for 0.15% of the total weight added therein to be prepared for use;

(4) weighing and mixing 576 kg of the hydride powders of the rare earth Fe—B compound and 24 kg of the hydride powders of the rare earth metals prepared respectively in steps (2) and (3), then airflow pulverizing them into fine powders; after mixing the powders for two hours, shaping them into a compact of 56 mm×40 mm×36 mm by orienting the magnet fields; putting the compact into the vacuum sintering furnace to sinter and temper; and finally the sintered Nd—Fe—B permanent magnet with excellent machineability is obtained.

In addition, according to the frequently adopted process in the existing technologies, 6 times of the amount of the raw materials is calculated based on the proportion of the mass fraction with 24.645% of Nd, 6.355% of Pr, 1% of Gd, 1% of B. 0.8% of Al, 0.3% of Nb, and 65.9% of Fe. The raw materials are weighed and prepared, and 186 kg of Nd—Pr alloy (in which Pr accounts for 20.5% of the total), 6 kg of Gd, 29.412 kg of Fe—B alloy (in which B accounts for 20.4% of the total), 4.8 kg of metal Al, 2.77 kg of Nb—Fe alloy (in which Nb accounts for 65% of the total), and 371.018 kg of pure iron, which together amount to 600 kg, are put into the vacuum fusion furnace to fuse and quickly condense into a casting alloy. This casting alloy is put into a hydrogen decrepitation furnace, which is then vacuumized to below 0.1 Pa and inflated with hydrogen to absorb hydrogen. It is heated after the hydrogen absorption reaches the saturation, at the same time, the vacuum extraction unit is started, and 14-hour thermal insulation is performed as the temperature is increased to 580° C. to perform dehydrogenation. The vacuum sintering furnace is inflated with argon after the thermal insulation and the cooling mechanism of the hydrogen decrepitation furnace is started to perform cooling. After being cooled, the casting alloy is airflow pulverized and the pulverized powders are mixed for two hours, with the antioxidant accounting for 0.15% of the total weight added therein before the mixture of powders. After that, the powders are shaped into a compact of 56 mm×40 mm×36 mm by orienting the magnet fields and then put into the vacuum sintering furnace to sinter and temper.

The magnetic properties of the sintered Nd—Fe—B permanent magnets prepared respectively in Example 3 based on the existing technology and the method of the present invention are tested. The two square magnets with specifications of 56 mm×40 mm×36 mm are machined, including grinded, cut and punched, etc., to be shaped as an annulus having an outside diameter of 4.3 mm, an inner diameter of 2.2 mm and a height of 2 mm. After the annulus being chamfered, polished, plated and finished, a complete inspection on cracks is performed. The comparative data of Example 3 is listed in Table 3.

TABLE 3

| Item | | Using the method of the present invention | Using the method in existing technology |
|---|---|---|---|
| Magnet Properties | Average value of remanence Br | 13.63 (KGs) | 13.61 (KGs) |
| | Average value of Coercivity Hci | 15.44 (KOe) | 15.52 (KOe) |
| | Average value of magnetic energy product (BH) max | 44.19 (MGOe) | 43.99 (MGOe) |
| Hydrogen content after dehydrogenation | | Rare earth Fe—B compound, 37ppm; Rare earth metals, 29 ppm | 2470 ppm |
| Dehydrogenation time | | 13 hours together for the rare earth Fe—B compound and the rare earth metals | 14 hours |
| Fine crack ratio after being cut into small pieces of magnet | | 0.19% | 13.2% |

From Table 3, it can be seen that in case of the substantially same preparation proportion, with different processes of casting and dehydrogenation and same processes of airflow pulverization, mixing, magnet field orienting and shaping, vacuum sintering and tempering, the two sintered Nd—Fe—B magnets differ little in remanence, magnetic energy product and coercivity, that is, the magnetic properties are almost same. With nearly the same dehydrogenation time, few fine cracks in the sintered Nd—Fe—B permanent magnet prepared by the method of the present invention show that, with the substantially same preparation proportion, application of the method of the present invention guarantees the magnetic properties of the sintered Nd—Fe—B permanent magnet and meanwhile, machineability of product is greatly improved, so that prominent economic effects are achieved.

Example 4

Figure 2:
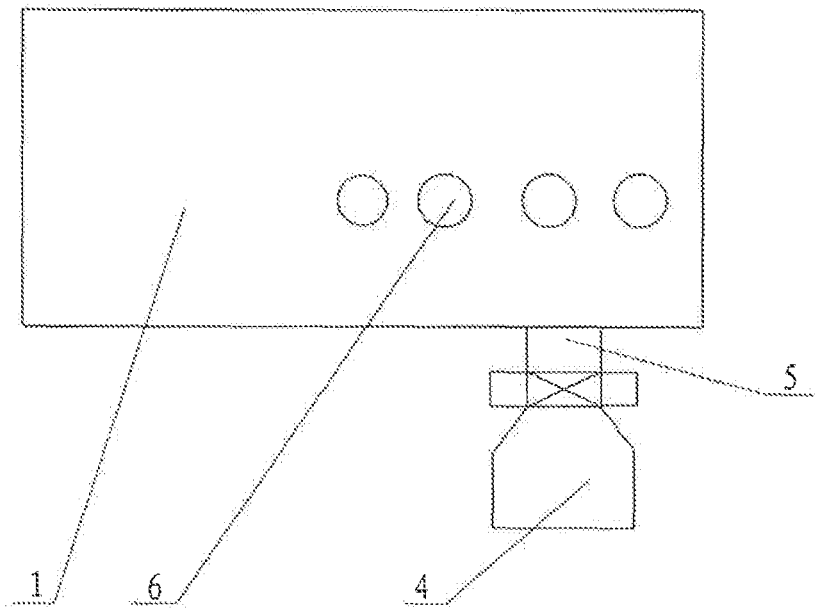
FIG. 2 is the side schematic view of the anti-oxidation device.
Figure 3:
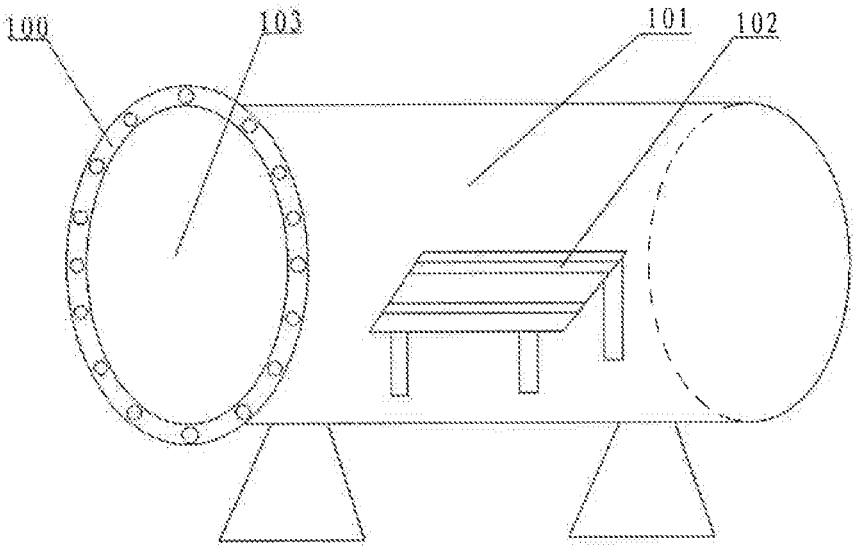
FIG. 3 is the structural diagram of a vacuum sintering furnace.

As shown in FIGS. 1 and 2, an anti-oxidation device includes a housing 1, with one end sealed and the other end opened, installed with a flange 100. There are inflating port 2 and exhausting port 3 provided with valves in the housing 1. At the bottom of the housing 1, a discharging port 5 connected with a storage tank 4 through a valve is provided. On the sidewalls of the housing 1, there are provided several operating ports 6, each of which is sealingly attached to a rubber sleeve. Inside the housing 1, a cooling means 7 and a discharging mechanism are installed, wherein the discharging mechanism includes a lifting device 10 installed therein, at the bottom of the housing 1, above which a base body 8 is installed. A telescope boom 9 capable of stretching out from the opening end of the housing 1 is slidingly connected with the base body 8 through a track.

The invention claimed is:

1. A method for preparing a sintered Nd—Fe—B permanent magnet, including the following steps:

(1) ingredient calculation comprising calculating ingredients according to the ingredient formula of the resultantly sintered Nd—Fe—B permanent magnet, the ingredient formula, in mass fraction, being $(Nd_{A-z}RE_z)_A(Fe_{J-y}M_y)_JB_C$, wherein RE represents one or more of rare earth elements except Nd, M represents one or more among the metal elements Al, Ga, Cu, Nb, Mo, W, V, Ta, Cr, Ti, Zr, Hf, Si, Ni, Sn, Mn, $28<A\leq 33$, $A>z\geq 0$, C ranges from 0.95 to 1.03, $J>y\geq 0$, and $A+C+J=100$;

(2) weighing and preparing raw materials for a rare earth Fe—B compound according to the formula, in mass fraction, of $(Nd_{28-g}RE_g)_{28}(Fe_{J-y}M_y)_JB_C$, wherein $28>g>0$, vacuum fusing the weighed and prepared raw materials for the rare earth Fe—B compound, and condensing them into a casting alloy of the rare earth Fe—B compound, followed by hydrogen absorption to decrepitate the casting alloy into hydride powders of the rare earth Fe—B compound, then heating the hydride powders of the rare earth Fe—B compound to a temperature between 400° C. and 420° C. for thermal insulation to perform dehydrogenation until the hydrogen content of the hydride powders of the rare earth Fe—B compound is below 50 ppm, thereby forming dehydrogenated powders of the rare earth Fe—B compound;

(3) separately from the weighing and preparing of the raw materials for the rare earth Fe—B compound, and separately from the condensing, the hydrogen absorption, and the dehydrogenation in step (2) to form dehydrogenated powders of the rare earth Fe—B compound, weighing and preparing raw materials consisting of rare earth metals according to the formula, in mass fraction, of $(Nd_{A-28-h}RE_h)_{A-28}$, wherein $A-h>28$ and $g+h=z$, performing hydrogen absorption on the weighed and prepared raw materials for the rare earth metals to decrepitate into hydride powders of the rare earth metals, then heating the hydride powders of the rare earth metals to a temperature between 830° C. and 860° C. for thermal insulation to perform dehydrogenation until the hydrogen content of the hydride powders of the rare earth metals is below 50 ppm, thereby forming dehydrogenated powders of the rare earth metals; and (4) mixing the dehydrogenated powders of both the rare earth Fe—B compound and the rare earth metals prepared respectively in steps (2) and (3), then airflow pulverizing them into fine powders, followed by magnetic field orienting and shaping, sintering and tempering, whereby the sintered Nd—Fe—B permanent magnet is obtained.

2. The method of claim 1, wherein, in steps (2) and (3), hydrogen absorption and decrepitation, and dehydrogenation of the rare earth Fe—B compound and the rare earth metals are performed in a vacuum furnace.

3. The method of claim 2, wherein, during the hydrogen absorption and decrepitation of step (2), the rare earth Fe—B compound is wrapped with a 1 mm-thick silica fire retardant cloth and put into an iron container in a charging amount not exceeding one seventh of a volume of the iron container.

4. The method of claim 2, wherein, during the hydrogen absorption and decrepitation of step (3), the rare earth metals are wrapped with a 1 mm-thick silica fire retardant cloth and put into an iron container in a charging amount not exceeding one seventh of a volume of the iron container.

5. The method of claim 3, further comprising, after the dehydrogenation of the hydride powders of the rare earth Fe—B compound:

initially cooling the powders of the rare earth Fe—B compound after dehydrogenation to a first temperature below 80° C. under the protection of argon in the vacuum furnace;

next, sealingly jointing the vacuum furnace with an anti-oxidation device and inflating the anti-oxidation device with argon until the oxygen content is below 0.1%;

transferring the iron container with the dehydrogenated powders of the rare earth Fe—B compound from the vacuum furnace into the anti-oxidation device by using a discharging mechanism of the anti-oxidation device;

cooling the powders to a second temperature less than the first temperature, the second temperature being below 20° C., through a fan of the anti-oxidation device; and unwrapping the fire retardant cloth having the dehydrogenated powders of the rare earth Fe—B compound to collect the dehydrogenated powders of the rare earth Fe—B compound into a storage tank connected with the anti-oxidation device, with an antioxidant accounting for 0.15% of the total weight of the dehydrogenated powders of the rare earth Fe—B compound to be prepared for use, wherein the anti-oxidation device includes a housing, with one end sealed and the other end opened and installed with a flange, in which an inflating port and an exhausting port are provided with valves, wherein a discharging port connected with the storage tank through a valve is provided at the bottom of the housing, a plurality of operating ports each of which is sealingly attached to a rubber sleeve are provided on the sidewalls of the housing, and the fan and the discharging mechanism are installed inside the housing, wherein the discharging mechanism includes a lifting mechanism installed therein, at the bottom of the housing, above which a base body is installed, and a telescope boom capable of stretching out from the opening end of the housing is slidingly connected with the base body through a track.

6. The method of claim 4, further comprising, after the dehydrogenation of the hydride powders of the rare earth metals:

initially cooling the powders of the rare earth metals after dehydrogenation to a first temperature below 80° C. under the protection of argon in the vacuum furnace;

next, sealingly jointing the vacuum furnace with an anti-oxidation device and inflating the anti-oxidation device with argon until the oxygen content is below 0.1%;

transferring the iron container with the dehydrogenated powders of the rare earth metals from the vacuum furnace into the anti-oxidation device by using a discharging mechanism of the anti-oxidation device;

cooling the powders to a second temperature less than the first temperature, the second temperature being below 20° C., through a fan of the anti-oxidation device; and unwrapping the fire retardant cloth having the dehydrogenated powders of the rare earth metals to collect the dehydrogenated powders of the rare earth metals into a storage tank connected with the anti-oxidation device, with an antioxidant accounting for 0.15% of the total weight of the dehydrogenated powders of the rare earth metals to be prepared for use, wherein the anti-oxidation device includes a housing, with one end sealed and the other end opened and installed with a flange, in which an inflating port and an exhausting port are provided with valves, wherein a discharging port connected with the storage tank through a valve is provided at the bottom of the housing, a plurality of operating ports each of which is sealingly attached to a rubber sleeve are provided on the sidewalls of the housing, and the fan and the discharging mechanism are installed inside the housing, wherein the discharging mechanism includes a lifting mechanism installed therein, at the bottom of the housing, above which a base body is installed, and a telescope boom capable of stretching out from the opening end of the housing is slidingly connected with the base body through a track.

* * * * *